US010605511B2

(12) United States Patent
Bertolini et al.

(10) Patent No.: US 10,605,511 B2
(45) Date of Patent: Mar. 31, 2020

(54) CLEAR ICE MAKER ASSEMBLY FOR PRODUCING CLEAR ICE FOR REFRIGERATOR APPLIANCE

(71) Applicants: BSH Home Appliances Corporation, Irvine, CA (US); BSH Hausgeräte GmbH, Munich (DE)

(72) Inventors: Nilton Bertolini, Knoxville, TN (US); Silas Patrick Mallon, Knoxville, TN (US); Jorge Carlos Montalvo Sanchez, Knoxville, TN (US); Vishal Vekariya, Knoxville, TN (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 125 days.

(21) Appl. No.: 15/968,776

(22) Filed: May 2, 2018

(65) Prior Publication Data

US 2019/0338995 A1 Nov. 7, 2019

(51) Int. Cl.

| | |
|---|---|
| ***F25C 1/18*** | (2006.01) |
| ***F25C 5/20*** | (2018.01) |
| ***F25C 5/18*** | (2018.01) |

(52) U.S. Cl.

CPC ..... *F25C 1/18* (2013.01); *F25C 5/18* (2013.01); *F25C 5/22* (2018.01); *F25C 2400/10* (2013.01); *F25C 2400/14* (2013.01)

(58) Field of Classification Search

CPC ..... F25C 1/18; F25C 5/22; F25C 5/18; F25C 2400/10

See application file for complete search history.

(56) References Cited

U.S. PATENT DOCUMENTS

| | | | | |
|---|---|---|---|---|
| 3,318,105 | A | 5/1967 | Burroughs | |
| 3,657,899 | A * | 4/1972 | Hosoda | F25C 1/12 62/137 |
| 3,686,890 | A | 8/1972 | Lyman | |
| 5,187,948 | A | 2/1993 | Frohbieter | |
| 5,297,394 | A | 3/1994 | Frohbieter et al. | |
| 5,946,924 | A * | 9/1999 | Kim | F25C 1/04 62/189 |
| 5,992,167 | A | 11/1999 | Hill et al. | |
| 6,964,177 | B2 * | 11/2005 | Lee | F25C 5/046 62/320 |
| 7,340,913 | B2 | 3/2008 | Miller et al. | |

(Continued)

*Primary Examiner* — Elizabeth J Martin

(74) *Attorney, Agent, or Firm* — Michael E. Tschupp; Andre Pallapies; Brandon G. Braun

(57) ABSTRACT

A refrigerator includes an ice compartment region disposed in at least one of a fresh food compartment or a freezer compartment; a clear ice maker assembly disposed in the ice compartment region and configured to make clear ice pieces; and an ice bucket configured to store the clear ice pieces made by the clear ice maker assembly. The clear ice maker assembly includes an ice maker tray portion having a plurality of cavities for forming clear ice pieces; a water distribution assembly configured to distribute a non-pressurized, even flow of water to each of the cavities of the ice maker tray portion; a water reservoir tank and a pump for supplying water to the water distribution assembly; and a water collection and return duct that is disposed below and extends along an edge of the ice maker tray portion to collect and return excess water to the water reservoir tank.

21 Claims, 14 Drawing Sheets

(56) References Cited

U.S. PATENT DOCUMENTS

| | | | | |
|---|---|---|---|---|
| 8,756,951 | B2 | 6/2014 | Bortoletto et al. | |
| 8,919,145 | B2 | 12/2014 | Bortoletto et al. | |
| 9,109,825 | B2 | 8/2015 | Boarman et al. | |
| 9,273,890 | B2 | 3/2016 | Bortoletto et al. | |
| 9,410,723 | B2 | 8/2016 | Boarman et al. | |
| 9,599,387 | B2 | 3/2017 | Boarman et al. | |
| 9,719,711 | B2 | 8/2017 | Bortoletto et al. | |
| 9,759,472 | B2 | 9/2017 | Boarman et al. | |
| 2004/0025527 | A1* | 2/2004 | Takahashi | F25C 1/18 62/340 |
| 2013/0167574 | A1* | 7/2013 | Yoon | F25C 1/24 62/340 |
| 2013/0276468 | A1 | 10/2013 | Buehrle et al. | |
| 2014/0165623 | A1* | 6/2014 | Guarino | F25C 1/24 62/72 |
| 2016/0370096 | A1* | 12/2016 | Yang | F25C 1/00 |
| 2017/0038112 | A1 | 2/2017 | Papalia | |
| 2017/0254577 | A1* | 9/2017 | Mitchell | F25C 5/182 |
| 2017/0299244 | A1 | 10/2017 | Alshourbagy et al. | |

* cited by examiner

CLEAR ICE MAKER ASSEMBLY FOR PRODUCING CLEAR ICE FOR REFRIGERATOR APPLIANCE

FIELD OF THE INVENTION

The present disclosure relates generally to a refrigerator appliance and to a clear ice maker assembly for producing clear ice for the refrigerator appliance. More particularly, the present disclosure relates to an automatic clear ice maker assembly for producing clear ice pieces that contain little or no impurities and are substantially free of trapped air, and to a clear ice maker assembly that can be fixed in the refrigerator appliance or used in place of a conventional automatic ice cube maker.

Moreover, the automatic clear ice maker assembly can be positioned, for example, in a dedicated ice making compartment located within a fresh food compartment of the refrigerator appliance or in a freezer compartment of the refrigerator appliance.

BACKGROUND OF THE INVENTION

In general, some users/customers prefer clear ice pieces that are free of impurities and trapped air for beverages and cocktails, because such clear ice pieces are not only aesthetically pleasing but also avoid altering the taste of the beverages and cocktails in which they are used.

There are known standalone or dedicated clear ice making machines for home and commercial use which can produce clear ice. However, these standalone clear ice machines are typically of substantial size and have high ice rates, and therefore consume significant amounts of water and energy. Moreover, the known standalone clear ice machines generally have no practical means of storing the produced clear ice pieces. These factors make the currently available clear ice products unsuitable for the light use that a domestic or home ice maker would experience in a typical household.

SUMMARY OF THE INVENTION

However, there is currently no home refrigerator appliance on the market with an installed automatic clear ice maker that is capable of producing clear ice pieces that contain little or no impurities and are substantially free of trapped air, as well as providing a capability to store the clear ice pieces produced.

An apparatus consistent with the present disclosure is directed to providing an automatic clear ice maker assembly that can be equipped in a refrigerator appliance at the time of manufacture.

An apparatus consistent with the present disclosure is directed to providing an automatic clear ice maker assembly that can be positioned for example in a dedicated ice making compartment located within a fresh food compartment of the refrigerator appliance or in a freezer compartment of the refrigerator appliance.

An apparatus consistent with the present disclosure is directed to providing a refrigerator appliance with an automatic clear ice maker assembly and that can maintain an appropriate temperature in a dedicated ice making compartment located within a fresh food compartment of the refrigerator appliance for storage of the clear ice pieces produced by the automatic clear ice maker assembly.

According to one aspect, the present disclosure provides a refrigerator comprising: an ice compartment region disposed in at least one of a fresh food compartment or a freezer compartment; a clear ice maker assembly disposed in the ice compartment region and configured to make clear ice pieces; and an ice bucket configured to store the clear ice pieces made by the clear ice maker assembly. The clear ice maker assembly includes an ice maker tray portion having a plurality of cavities for forming the clear ice pieces; a water distribution assembly configured to distribute a non-pressurized, even flow of water to each of the cavities of the ice maker tray portion; a water reservoir tank and a pump for supplying water from the water reservoir tank to the water distribution assembly; and a water collection and return duct that is disposed below and extends along an edge of the ice maker tray portion and is configured to collect and return excess water to the water reservoir tank.

According to another aspect, the ice compartment region is disposed in the fresh food compartment.

According to another aspect, the ice compartment region is disposed in the freezer compartment.

According to another aspect, the ice compartment region is disposed in an upper corner of the fresh food compartment.

According to another aspect, the ice bucket is removably mounted in the ice compartment region as a removable ice bucket.

According to another aspect, the removable ice bucket has a front cover, and the front cover has an opening in a bottom portion for discharging the clear ice pieces.

According to another aspect, the fresh food compartment includes a door, and further comprising an ice chute for an ice dispenser and being disposed in the door, the ice chute being configured to communicate with the opening in the front cover via an ice chute extension and to guide the clear ice pieces from the opening in the front cover to the ice dispenser.

According to another aspect, the clear ice pieces are substantially free of impurities and are substantially free of trapped air.

According to another aspect, the refrigerator is a French door-bottom mount configuration having the fresh food compartment on top and the freezer compartment below the fresh food compartment.

According to another aspect, the clear ice maker assembly includes an evaporator cooling tube that contacts the ice maker tray portion.

According to another aspect, the water distribution assembly comprises a water distribution part having a water outlet tube that is connected to an outlet of the pump and has a plurality of water outlets so as to form a water distribution bar, and a plurality of water chambers, and wherein of the plurality of water outlets is provided to respectively supply water to the plurality of water chambers which in turn respectively supply water to the plurality of cavities.

According to another aspect, the water distribution part comprises a return duct disposed adjacent to the plurality of water chambers and separated by a dividing wall, the dividing wall having notches respectively communicating with each of the plurality of water chambers, such that excess water in each water chamber flows over the notches in the dividing wall and into the return duct.

According to another aspect, the water collection and return duct communicates via a fill cup with the return duct of the water distribution part, thereby to return excess water from the water distribution part to the water reservoir tank.

According to another aspect, the return duct of the water distribution part has an outlet in a bottom wall at a rear end of the return duct of the water distribution part.

According to another aspect, the present disclosure provides a clear ice maker assembly for use in a home refrigerator appliance, the clear ice maker assembly comprising: an ice maker tray portion having a plurality of cavities for forming clear ice pieces; a water distribution assembly configured to distribute a non-pressurized, even flow of water to each of the cavities of the ice maker tray portion; a water reservoir tank and a pump for supplying water from the water reservoir tank to the water distribution assembly; and a water collection and return duct that is disposed below and extends along an edge of the ice maker tray portion and is configured to collect and return excess water to the water reservoir tank.

According to another aspect, wherein the water distribution assembly comprises a water distribution part having a water outlet tube that is connected to an outlet of the pump and has a plurality of water outlets so as to form a water distribution bar, and a plurality of water chambers, and wherein the plurality of water outlets is provided to respectively supply water to the plurality of water chambers which in turn respectively supply water to the plurality of cavities.

According to another aspect, the water distribution part comprises a return duct disposed adjacent to the plurality of water chambers and separated by a dividing wall, the dividing wall having notches respectively communicating with each of the plurality of water chambers, such that excess water in each water chamber flows over the notches in the dividing wall and into the return duct.

According to another aspect, the water collection and return duct communicates via a fill cup with the return duct of the water distribution part, thereby to return excess water from the water distribution part to the water reservoir tank.

According to another aspect, the return duct of the water distribution part has an outlet in a bottom wall at a rear end of the return duct of the water distribution part.

According to another aspect, the water reservoir tank is detachable from the clear ice maker assembly, so that the water reservoir tank can be removed manually for periodic cleaning or manual filling.

According to another aspect, the clear ice pieces are substantially free of impurities and are substantially free of trapped air.

According to another aspect, the present disclosure provides a refrigerator comprising: a French door-bottom mount configuration having a fresh food compartment on top and a freezer compartment below the fresh food compartment; an insulated ice compartment region disposed in the fresh food compartment; a clear ice maker assembly disposed in the insulated ice compartment region and configured to make clear ice pieces; and an ice bucket configured to store the clear ice pieces made by the clear ice maker assembly, wherein the clear ice maker assembly comprises: an ice maker tray portion having a plurality of cavities for forming the clear ice pieces; a water distribution assembly configured to distribute a non-pressurized, even flow of water to each of the cavities of the ice maker tray portion; a water reservoir tank and a pump for supplying water from the water reservoir tank to the water distribution assembly; and a water collection and return duct that is disposed below and extends along an edge of the ice maker tray portion and is configured to collect and return excess water to the water reservoir tank.

According to another aspect, the clear ice maker assembly includes an evaporator cooling tube that contacts the ice maker tray portion.

According to another aspect, the clear ice pieces are substantially free of impurities and are substantially free of trapped air.

BRIEF DESCRIPTION OF THE DRAWING FIGURES

The accompanying drawing figures incorporated in and forming a part of this specification illustrate several aspects of the invention, and together with the description serve to explain the principles of the invention.

Figure 2A:
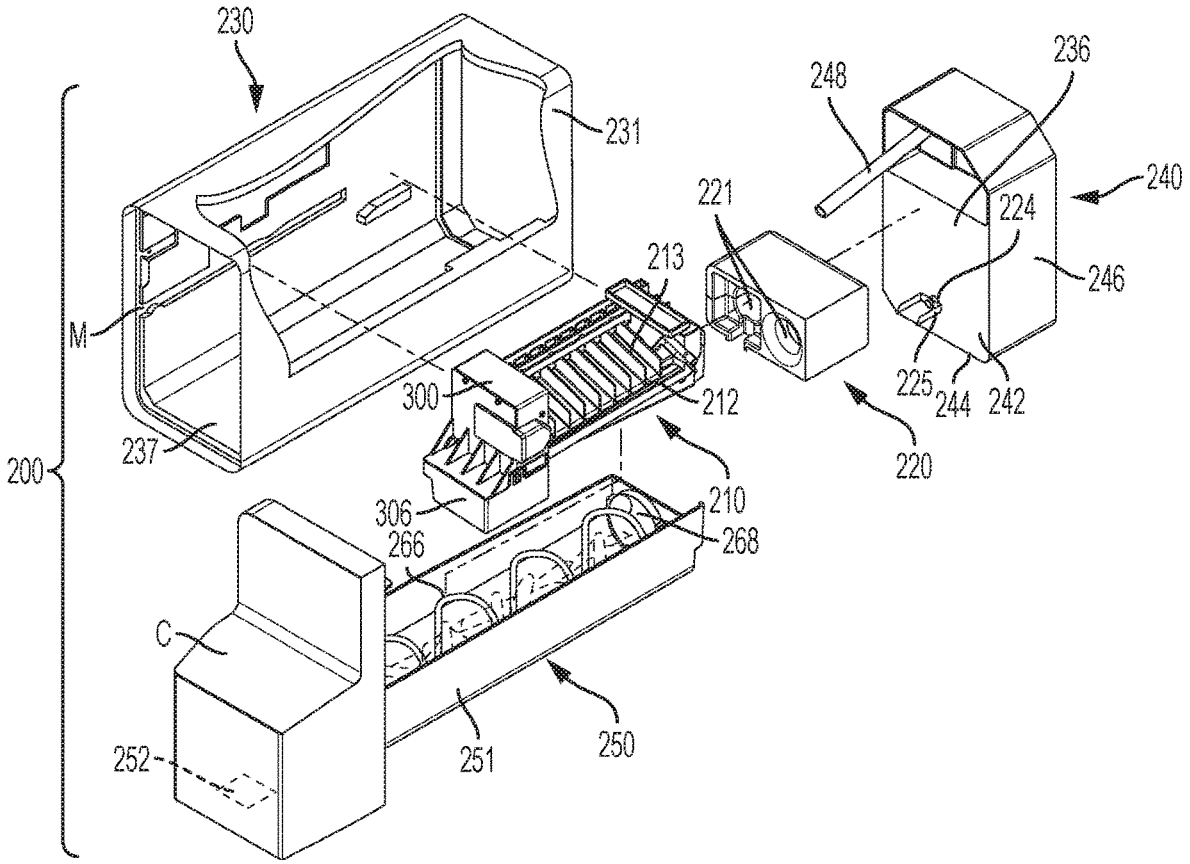
FIG. 2A is an exploded perspective view showing the ice compartment region of FIG. 1 including the major components of the clear ice maker assembly according to one exemplary embodiment consistent with the present disclosure.
Figure 2B:
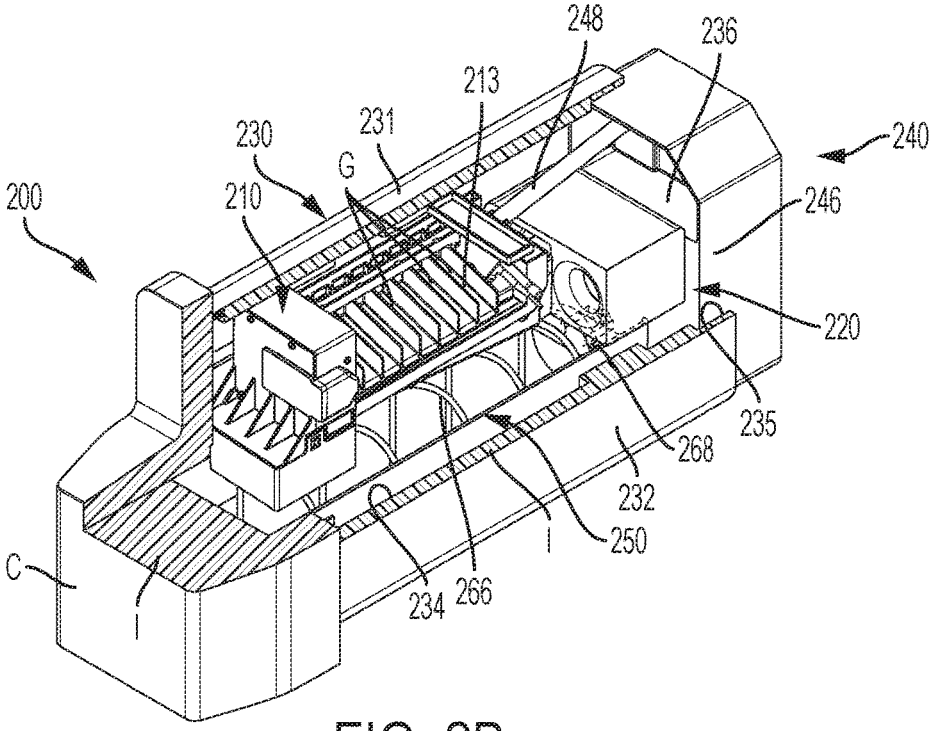
FIG. 2B is a cutaway perspective view of the ice compartment region of FIG. 1 including the major components of the clear ice maker assembly according to one exemplary embodiment consistent with the present disclosure.
Figure 3A:
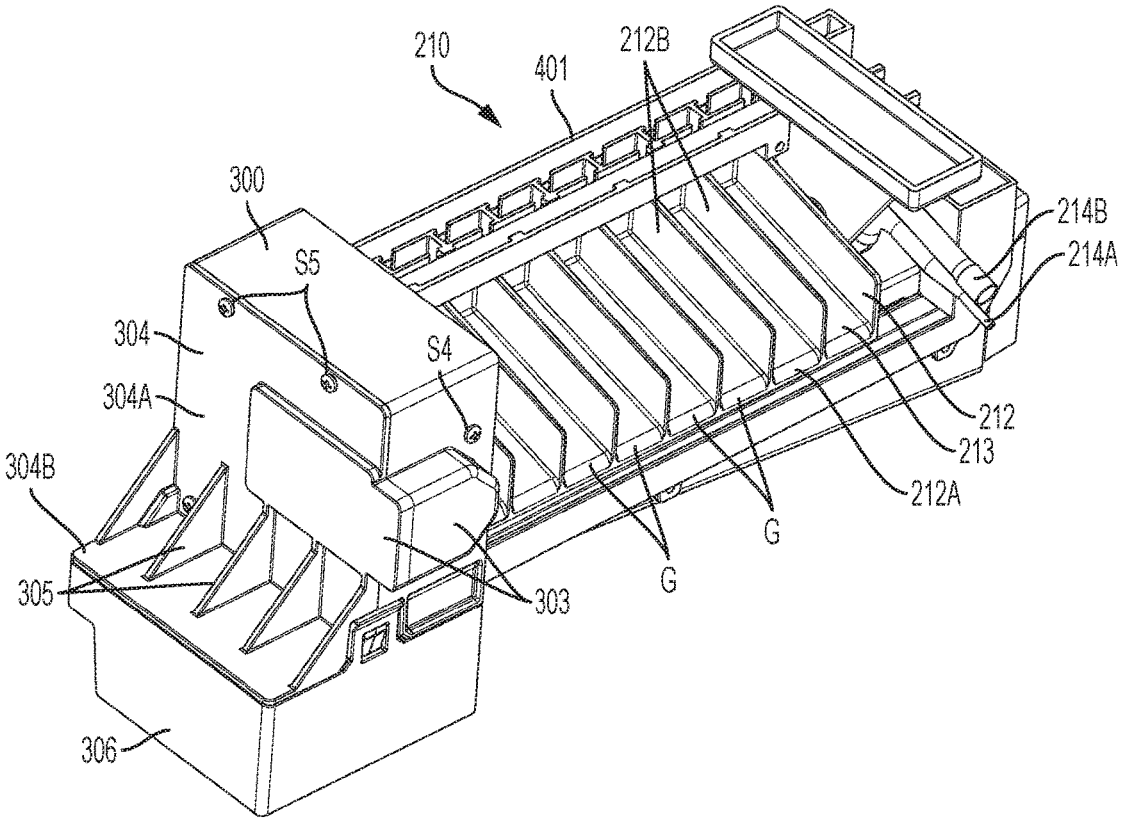
Figure 3B:
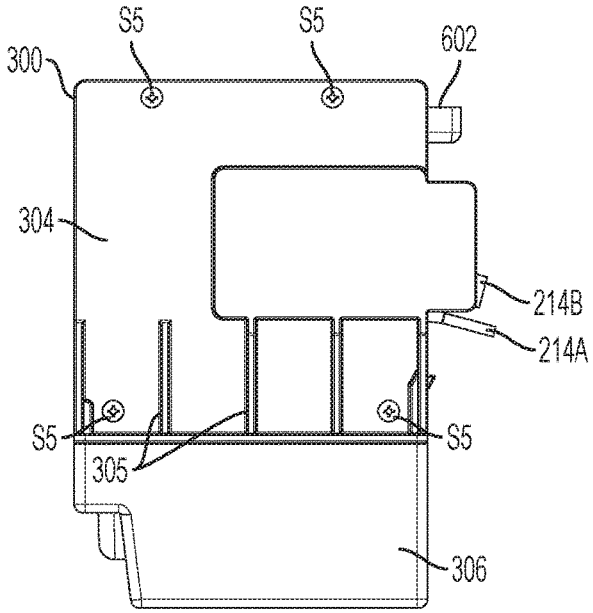
Figure 3C:
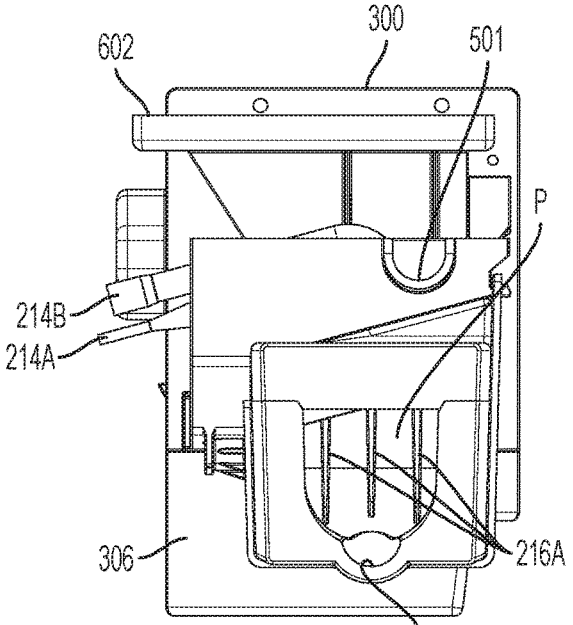
Figure 3D:
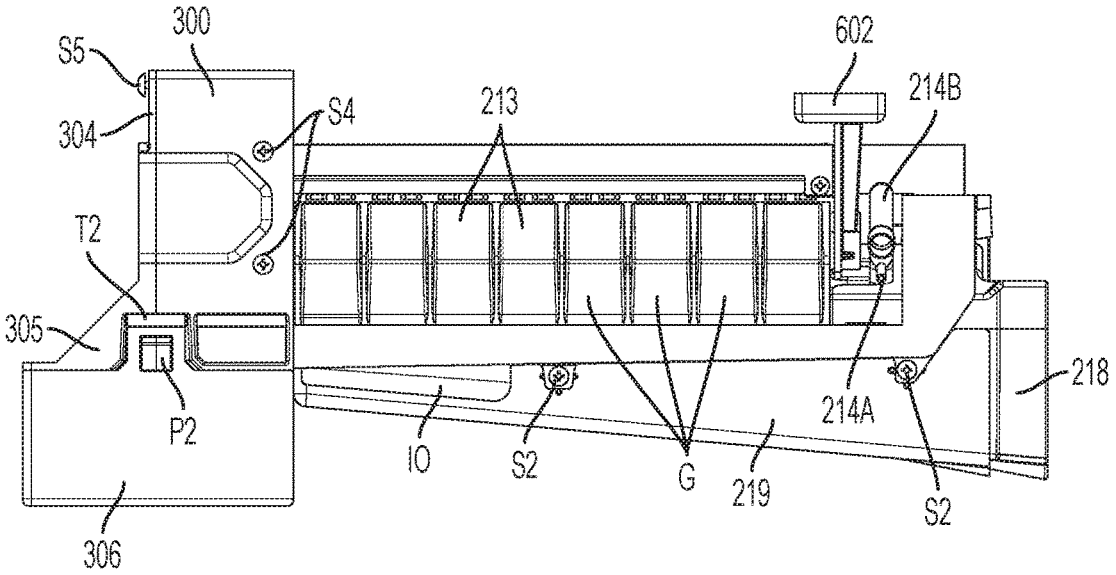
Figure 3E:
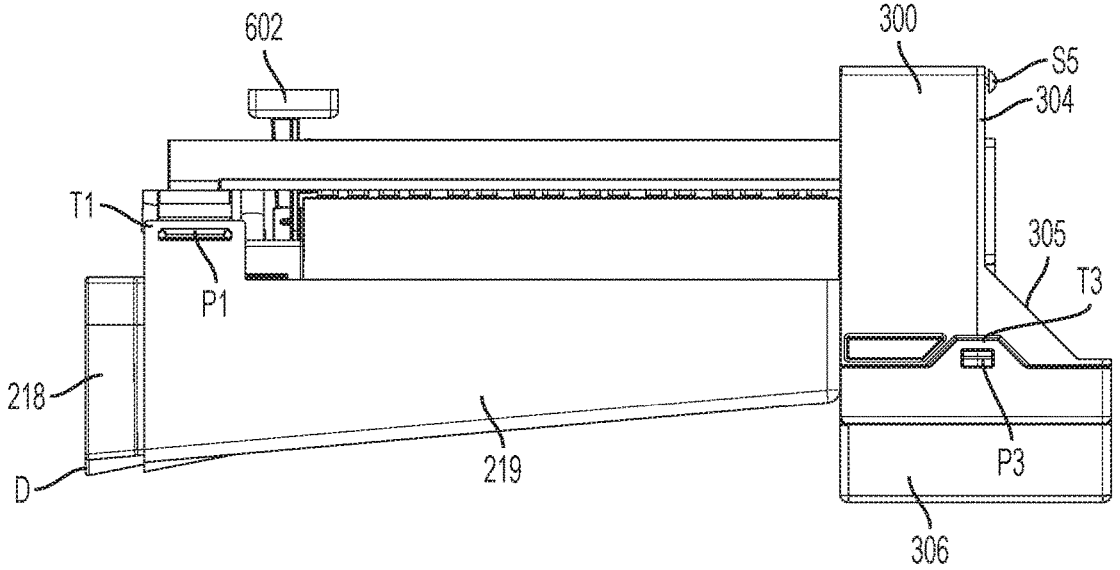
Figure 3F:
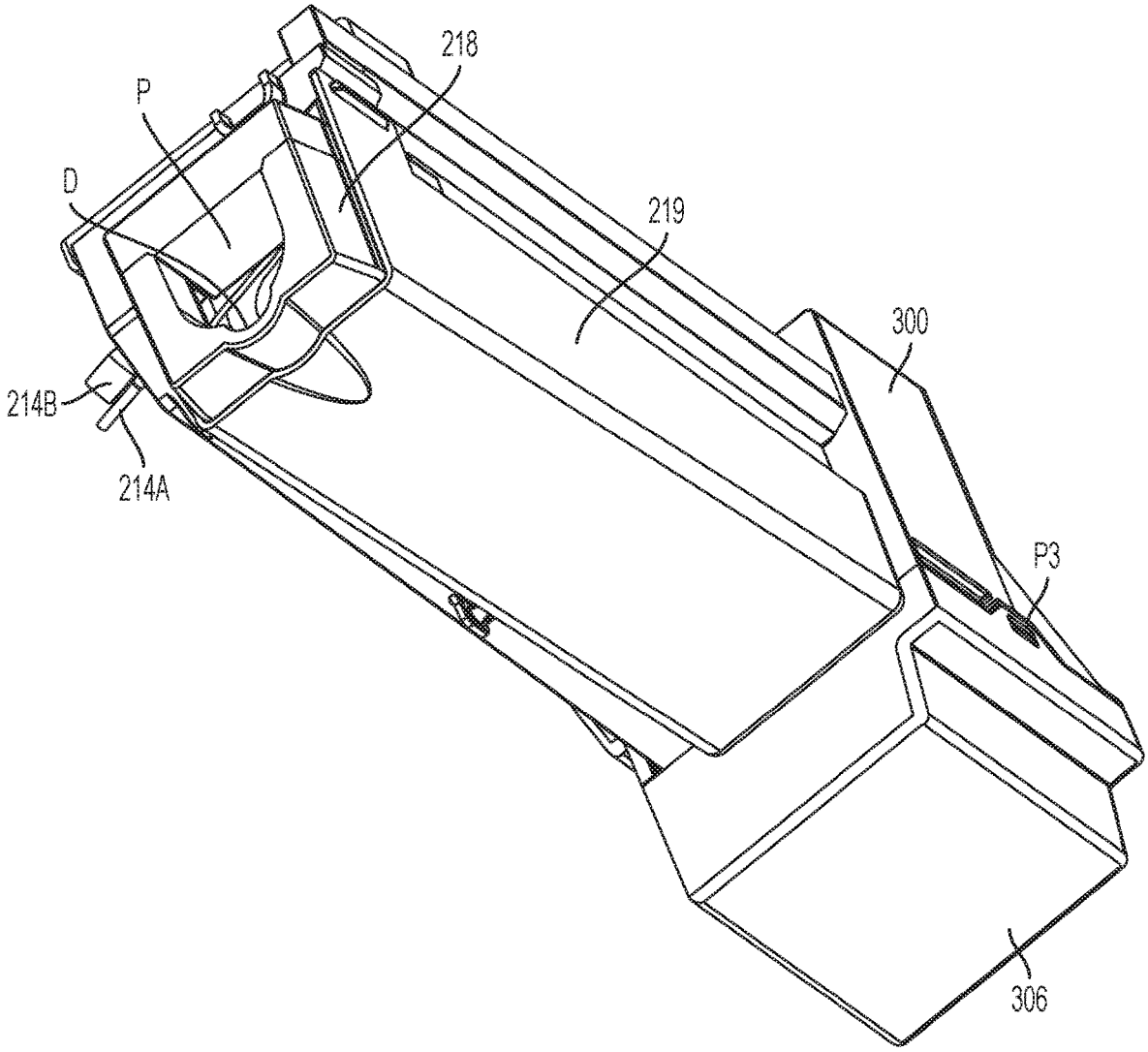
Figure 3G:
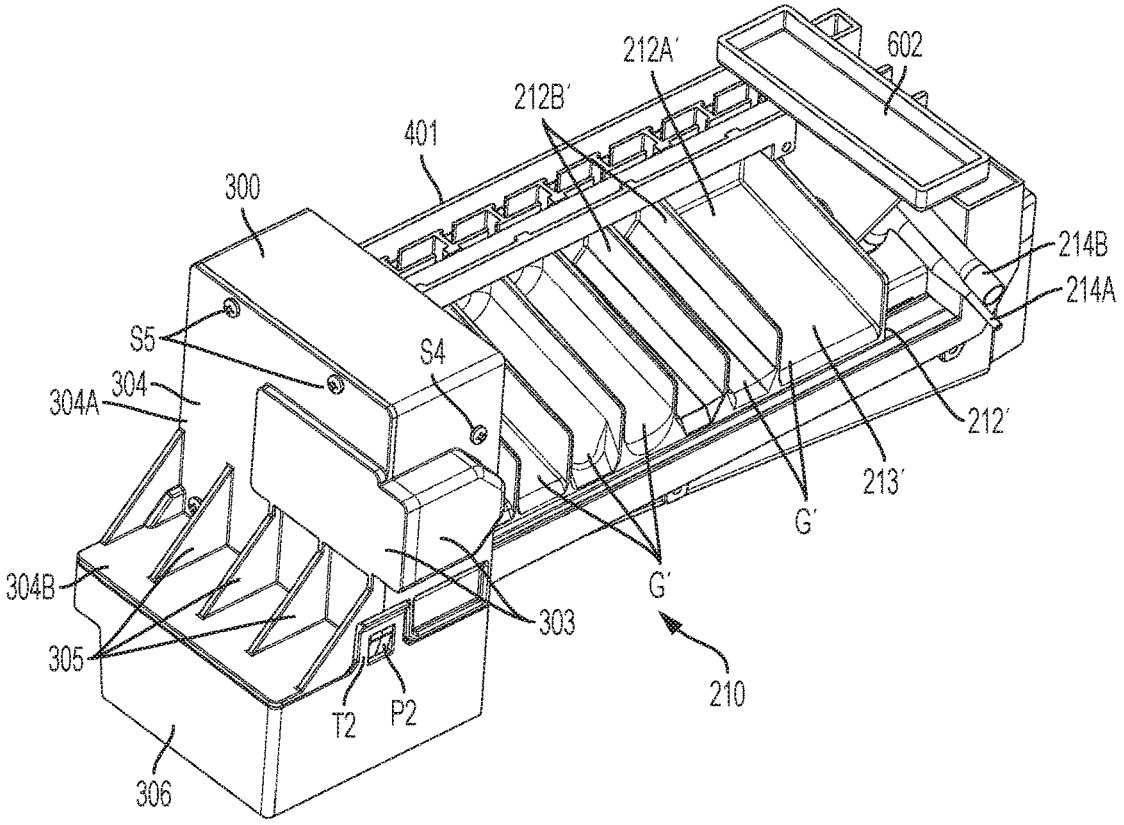
Figure 3H:
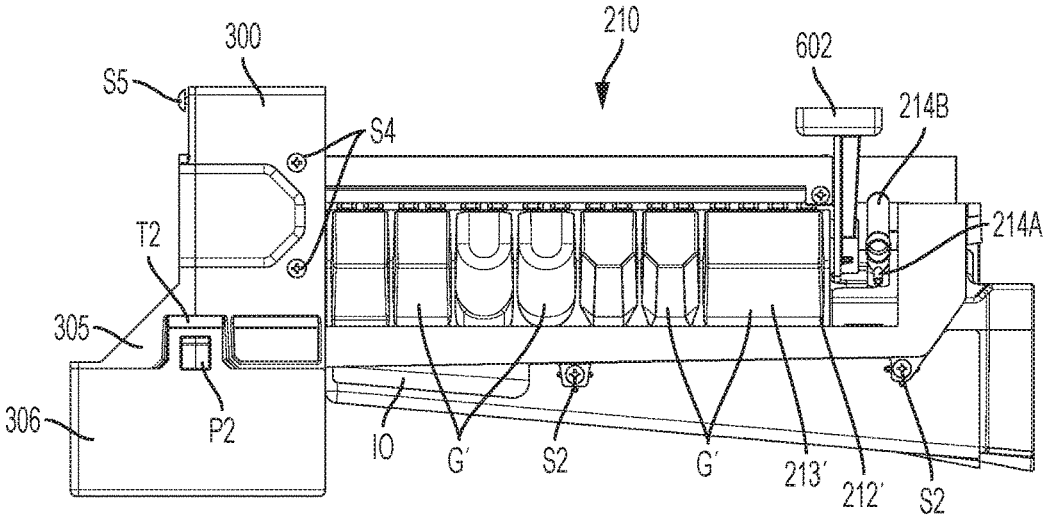
Figure 4B:
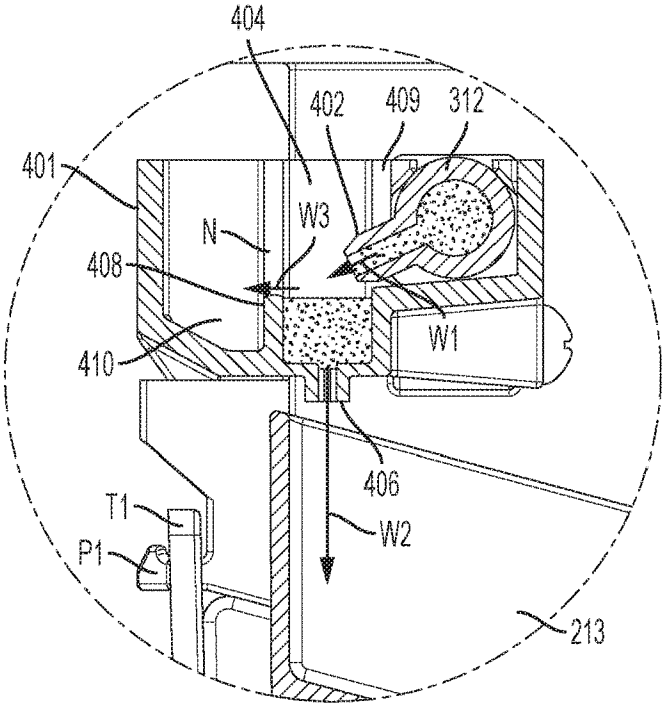
Figure 4A:
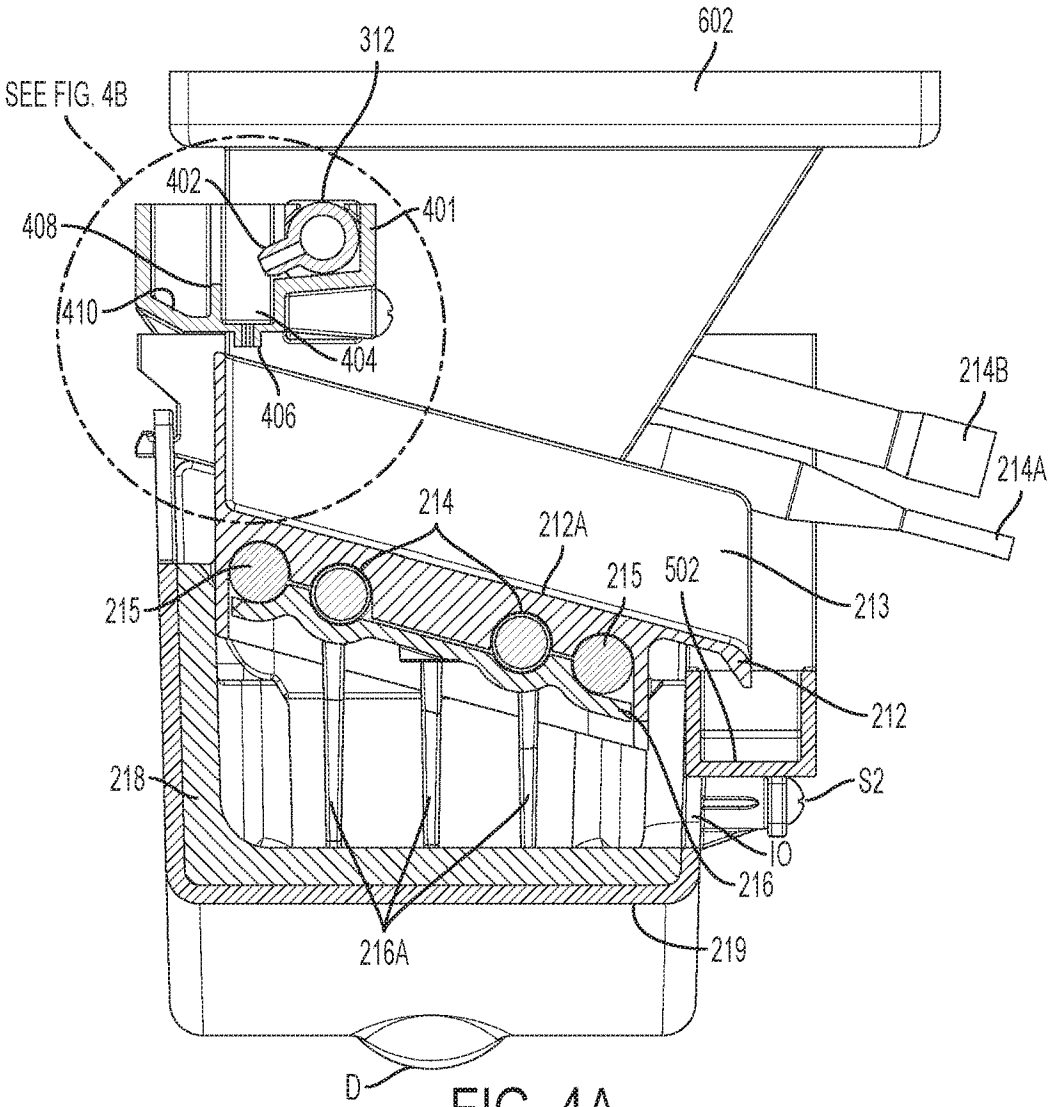
Figure 4C:
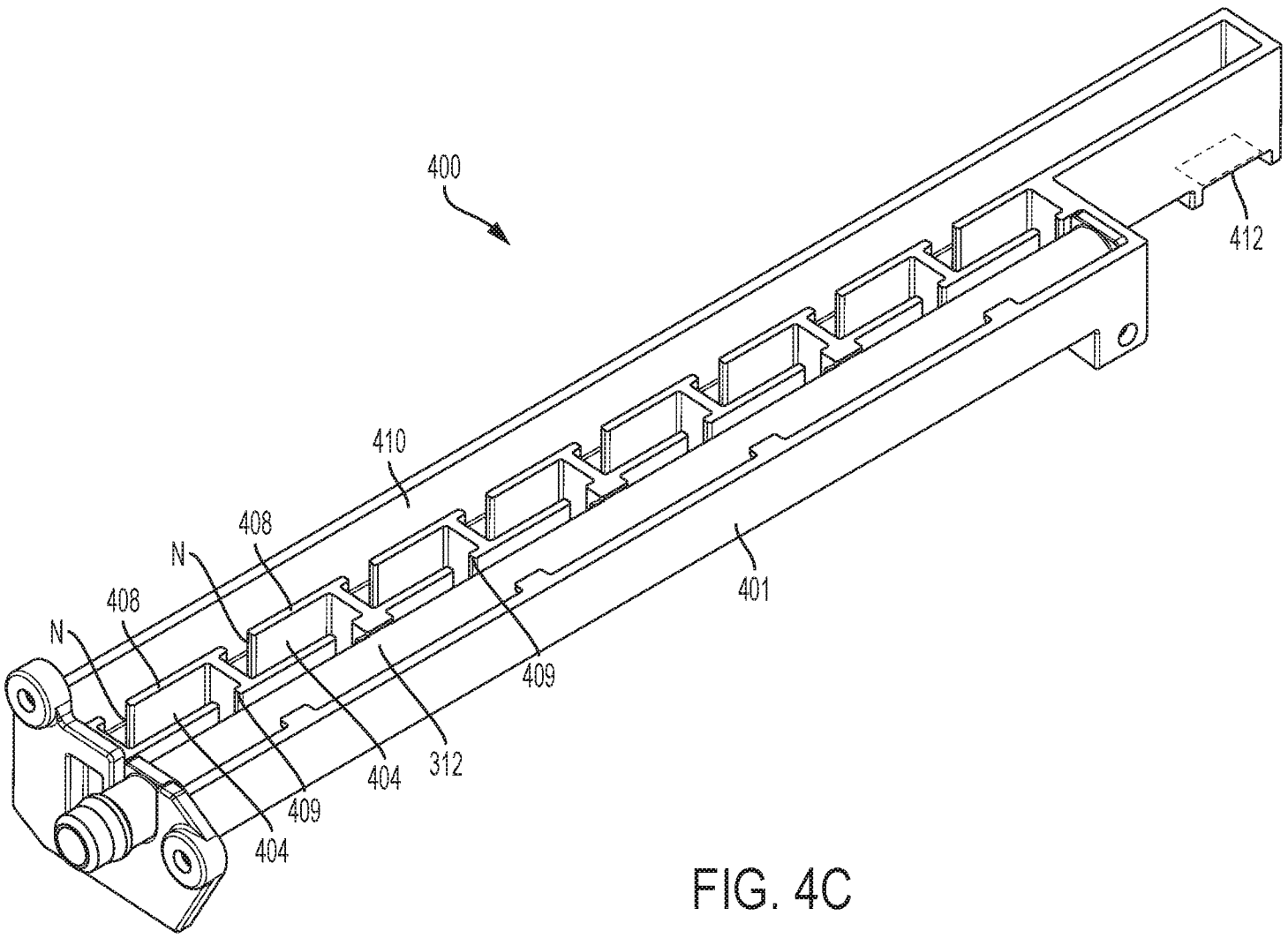
Figure 5:
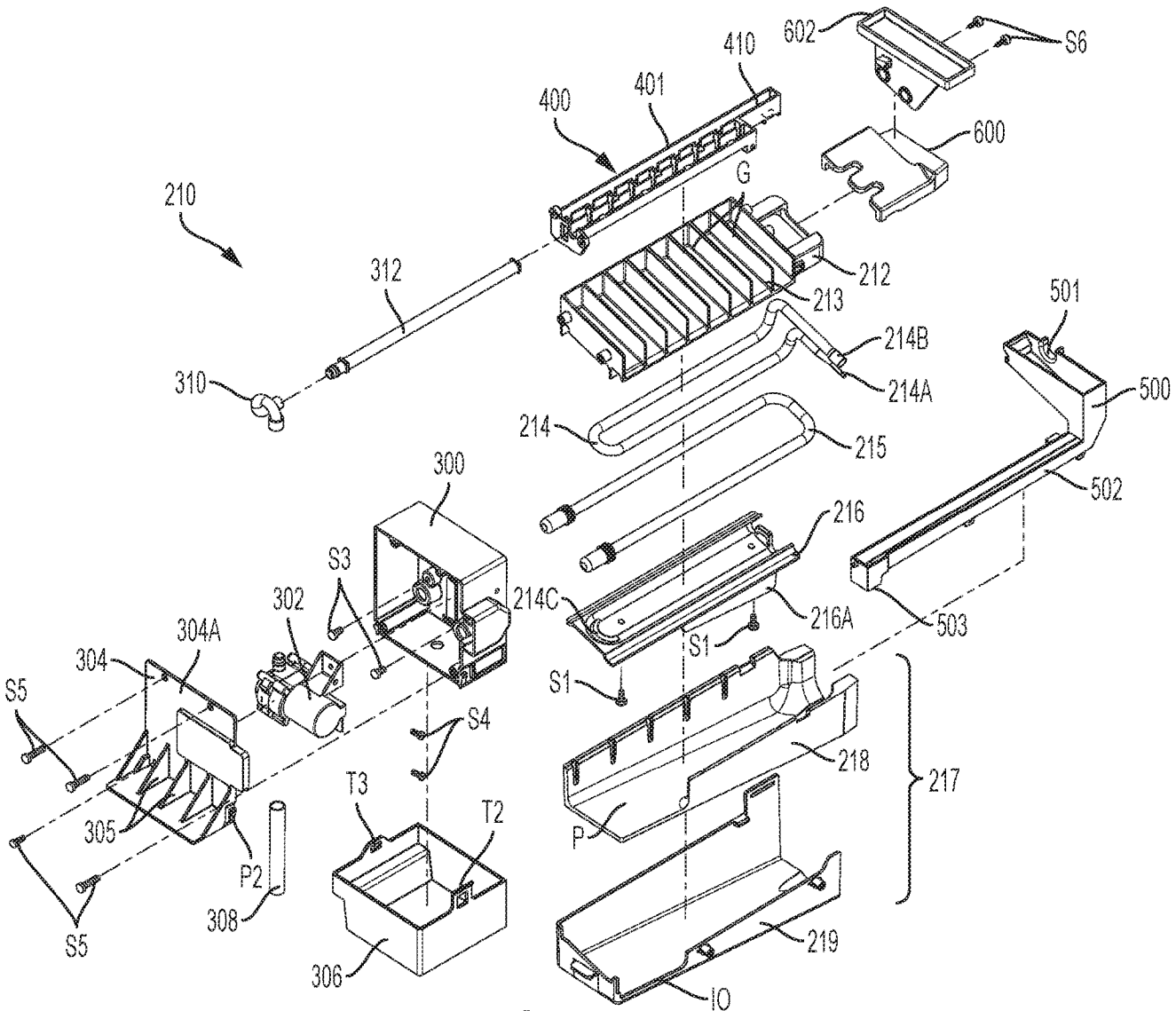
Figure 6:
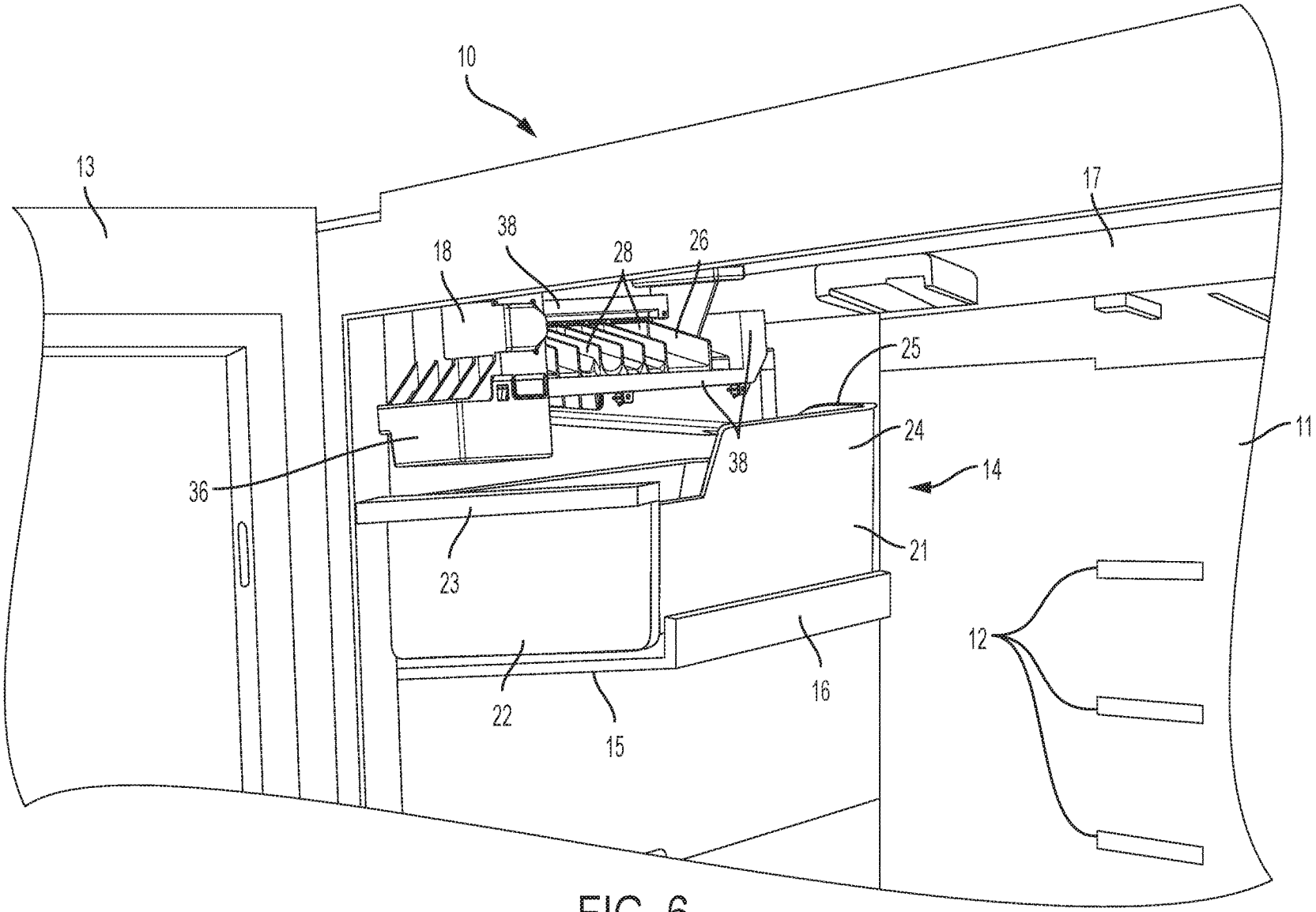
Figure 7:
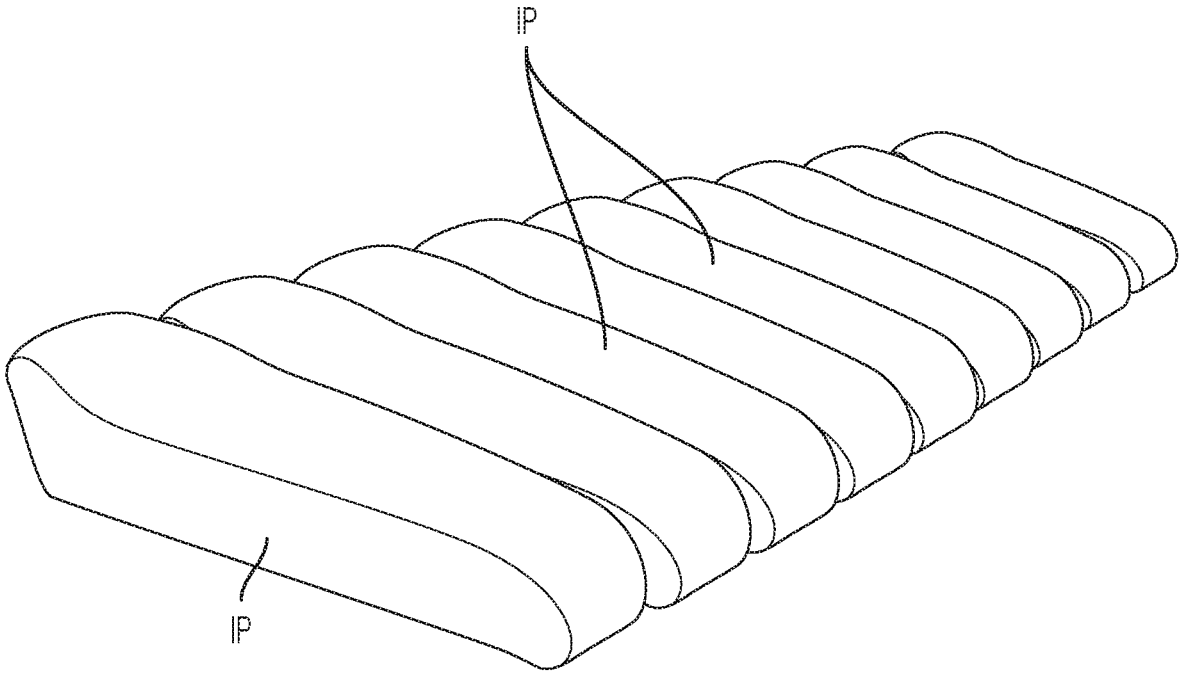

FIGS. 3A, 3B, 3C, 3D, 3E, and 3F are a perspective view, a front elevational view, a rear elevational view, a right side elevational view, a left side elevational view, and a bottom, rear perspective view, respectively, of the clear ice maker assembly for producing clear ice, with FIGS. 3A and 3D showing the ice tray portion having equal ice geometries (as also shown in FIGS. 2A, 2B, and 5) according to one exemplary embodiment consistent with the present disclosure;

FIGS. 3G and 3H are a perspective view and a right side elevational view, respectively, of the clear ice maker assembly for producing clear ice having several different ice geometries in the ice tray portion according to another exemplary embodiment consistent with the present disclosure;

FIGS. 4A, 4B, 4C, and 4D are a sectional view, an enlarged sectional view of FIG. 4A, a perspective view, and a top view, respectively, to explain various portions of the water distribution assembly of the clear ice maker assembly according to one exemplary embodiment consistent with the present disclosure;

FIG. 5 is an exploded perspective view of the entire clear ice maker assembly for producing clear ice according to one exemplary embodiment consistent with the present disclosure;

FIG. 6 is a fragmentary perspective view showing the inside of a refrigerator appliance including an automatic clear ice maker assembly in an ice compartment region located in a freezer compartment according to another exemplary embodiment consistent with the present disclosure; and FIG. 7 is a fragmentary perspective view of the clear ice maker assembly showing an example of the clear ice that is produced according to one exemplary embodiment consistent with the present disclosure.

DETAILED DESCRIPTION OF THE EXEMPLARY EMBODIMENTS

The exemplary embodiments set forth below represent the necessary information to enable those skilled in the art to practice the invention. Upon reading the following description in light of the accompanying drawing figures, those skilled in the art will understand the concepts of the invention and will recognize applications of these concepts not particularly addressed herein. It should be understood that these concepts and applications fall within the scope of the disclosure and the accompanying claims.

Moreover, it should be understood that terms such as top, bottom, front, rear, middle, upper, lower, right side, left side, vertical, horizontal, downward, upward, and the like used herein are for orientation purposes with respect to the drawings when describing the exemplary embodiments and should not limit the present invention unless explicitly indicated otherwise in the claims. Also, terms such as substantially, approximately, and about are intended to allow for variances to account for manufacturing tolerances, measurement tolerances, or variations from ideal values that would be accepted by those skilled in the art.

As used herein, the terms "clear ice" or "clear ice pieces" refer to ice or ice pieces that are substantially free of impurities and are substantially free of trapped air. The clear ice or clear ice pieces are not limited to a particular shape or size. Impurities commonly found in ice, such as dissolved minerals and salts, can significantly alter the taste of a beverage. These impurities can also result in oxidation occurring in some beverages, further reducing the quality of the beverage. An apparatus consistent with the present disclosure is directed to providing an automatic clear ice maker that is capable of producing clear ice pieces that are substantially free of impurities and are substantially free of trapped air, as well as providing a capability to store the clear ice pieces produced.

Figure 1:
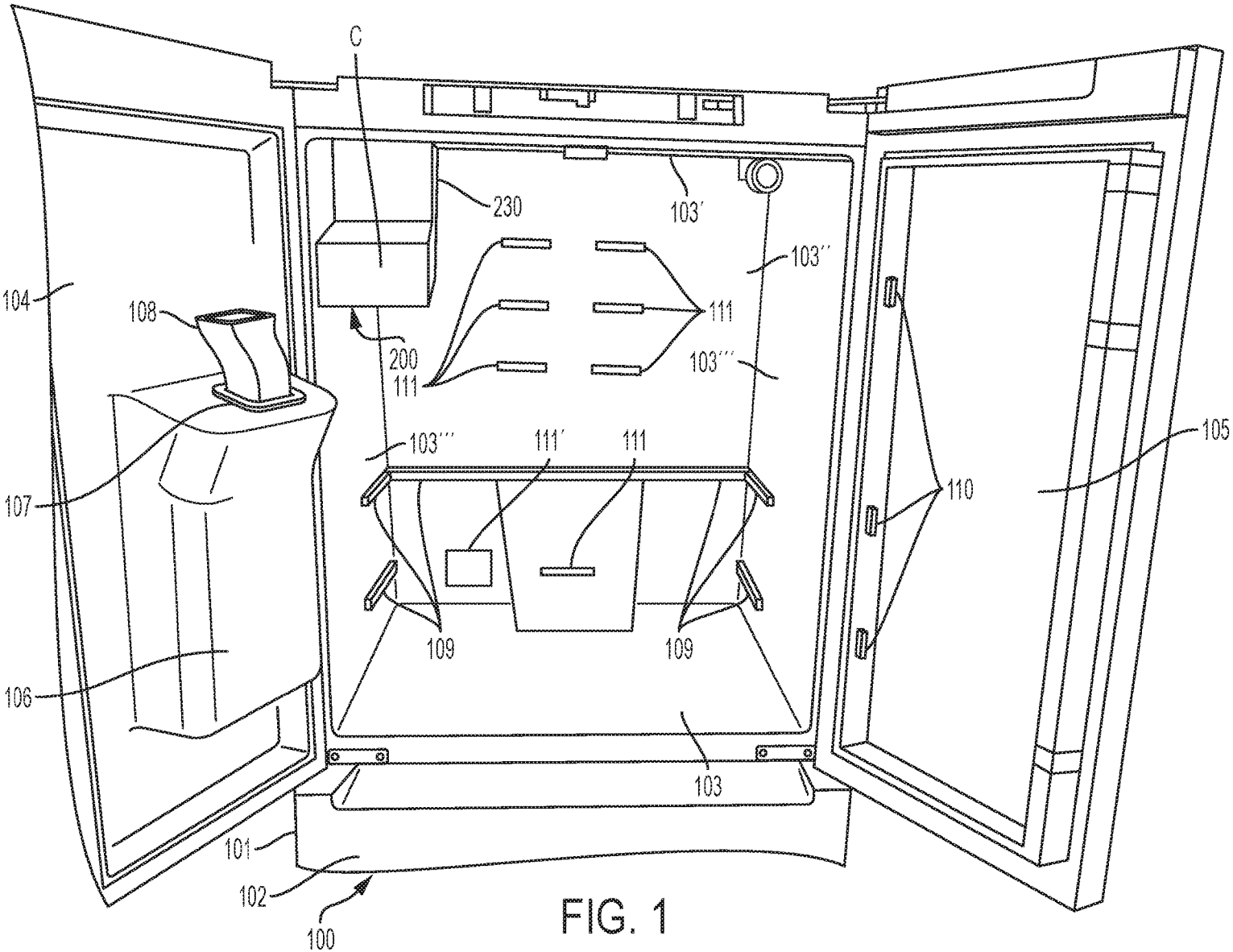
FIG. 1 is a fragmentary perspective view showing the inside of a refrigerator appliance including an automatic clear ice maker assembly for producing clear ice in an ice compartment region located in a fresh food compartment according to an exemplary embodiment consistent with the present disclosure.

FIG. 1 illustrates a front perspective view of a French door-bottom mount style refrigerator 100 with the doors open to reveal an ice compartment region 200 according to an exemplary embodiment consistent with the present disclosure. More specifically, the refrigerator 100 includes an insulated body having a freezer compartment 101 (bottom mount style) covered by a freezer door 102, and a fresh food compartment 103 (also referred to as a refrigerator compartment 103) located above the freezer compartment 101 and having two refrigerator doors 104 and 105 (French door style) which are shown in the open position. While two refrigerator doors are shown, clearly a single refrigerator door could be used, or more than two doors such as with door-in-door configurations. The shelves and food racks have been removed from inside the fresh food compartment 103 and from the inside of the refrigerator doors 104 and 105 for ease of understanding. The left door 104 includes a projecting housing portion 106 on the inner liner and which accommodates a water and ice dispenser assembly (not visible) accessible by the user on the front side of the door 104. An opening 107 of a dispenser ice chute (not visible) for guiding the clear ice to the dispenser is arranged at the top of the projecting housing portion 106. The dispenser ice chute communicates with an opening 252 (see FIG. 2A) in a front cover C of the ice bucket assembly via an ice chute extension 108. The inner liner side walls of the fresh food compartment 103 include protrusions 109 for supporting shelving (not shown). The right door 105 includes projections 110 for supporting door racks (not shown). Also shown in FIG. 1 are air openings 111 for cold air to enter into the fresh food compartment 103 (see the smaller elongated slots) and an opening 111' for return air to exit the fresh food compartment 103 (see the larger square opening on the bottom left). The freezer compartment is typically set at −18° C. or colder, and the fresh food compartment is typically set in a range of 1° C. to 4° C.

FIGS. 2A and 2B are an exploded perspective view and a cutaway perspective view, respectively, of the ice compartment region 200 of FIG. 1 according to one exemplary embodiment consistent with the present disclosure (note that a mounting bracket for the ice maker assembly has been removed in FIGS. 2A and 2B for ease of understanding). More specifically, the ice compartment region 200 includes the major components of: an automatic clear ice maker assembly 210, an air handler assembly 220, an ice compartment housing assembly 230, a rear housing portion 240, and an ice storage bucket assembly 250 with front cover C. Aspects of each of the individual assemblies 210-250 will be discussed in more detail below in connection with the drawings.

As shown in FIGS. 2A and 2B, the ice maker assembly 210 is preferably configured as one that utilizes direct cooling where an evaporator cooling tube either contacts or is embedded in an ice maker tray portion 212. The clear ice maker assembly 210 for producing clear ice has a plurality of distinct ice cavities 213 preferably, but not necessarily, having equal ice geometries G in the ice maker tray portion 212. As shown in FIG. 3A, the ice maker tray portion 212 comprises an evaporator plate 212A having a plurality of vertical plates or projections 212B which are spaced apart to form the individual cavities 213. The details of the ice maker assembly 210 will be discussed in more detail below in connection with FIGS. 3A to 3H and FIG. 5. While a direct cooling type ice maker assembly 210 is shown in FIGS. 2A to 3H and FIG. 5, other types of ice makers can also be used, such as but not limited to, ice makers using plastic trays, metallic trays, or composite trays of both metal and plastic, or other means of direct cooling such as with a Peltier cell or ducted air. Moreover, the present disclosure does not limit the ice type/shape produced by the ice maker.

Figure 2C:
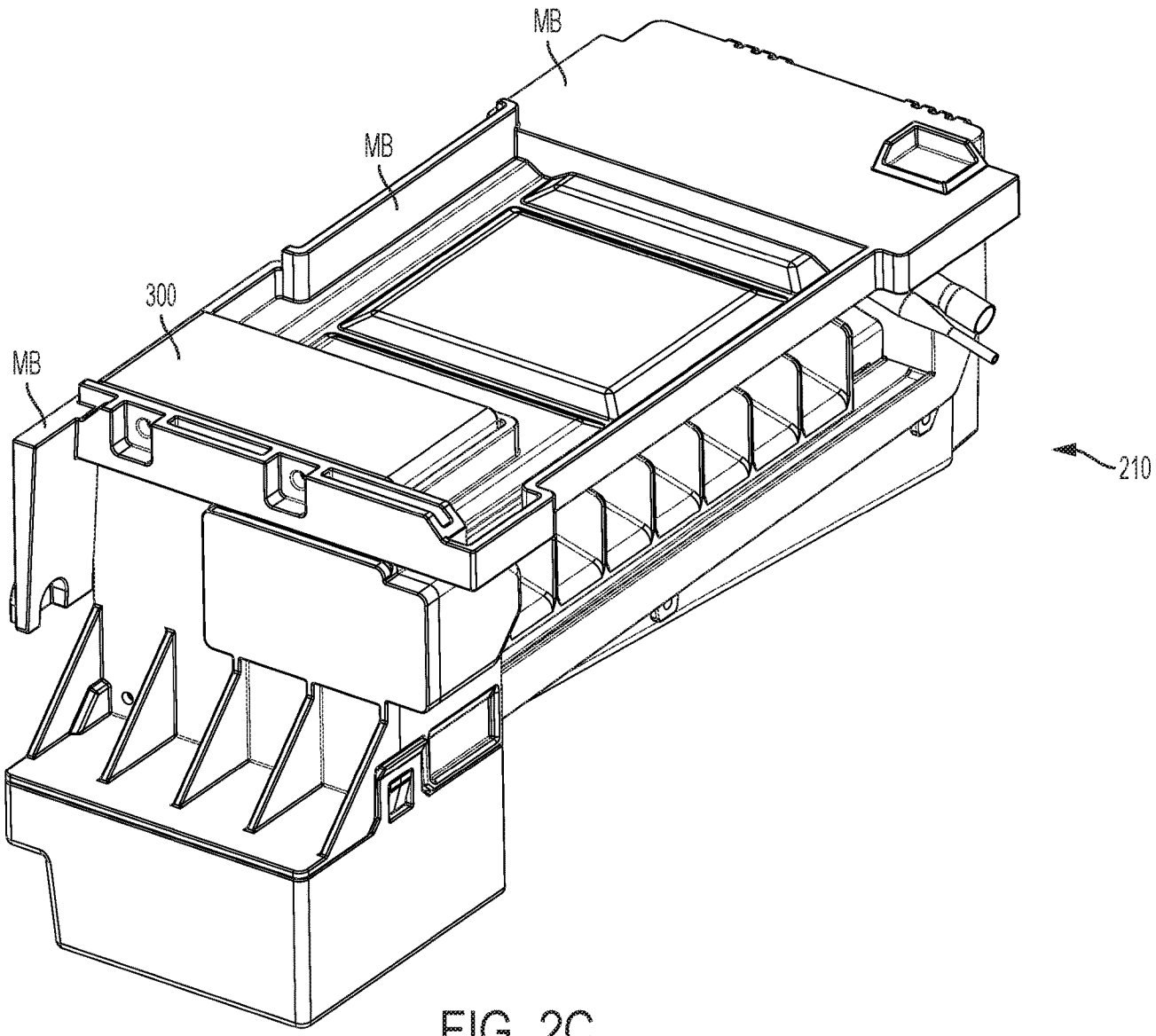
FIGS. 2C and 2D are a perspective view and a front elevational view, respectively, showing the mounting bracket for the ice maker assembly according to one exemplary embodiment consistent with the present disclosure.
Figure 2D:
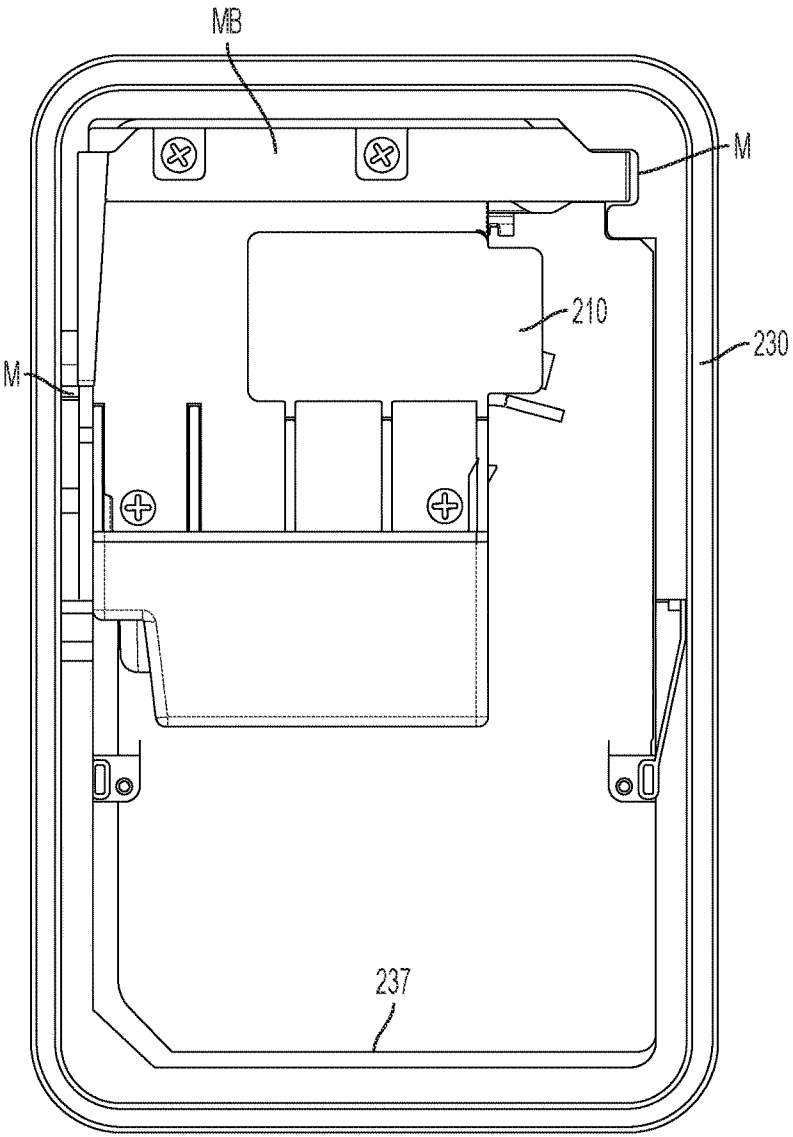

The clear ice maker assembly 210 may include a mounting bracket MB disposed on the top and extending down on one side to slidably engage with corresponding mounting grooves M on the inner walls of the ice compartment housing assembly 230 (see FIGS. 2A, 2C, and 2D). A wire harness (not shown) for connecting the clear ice maker assembly 210 to the refrigerator 100 may be connected to corresponding connectors (not shown) in, for example, the inner top wall or the back wall of ice compartment housing assembly 230 or the inner top wall 103' of the fresh food compartment 103 at a location within the ice compartment region 200. In the preferred embodiment and as discussed in more detail below, a defrost-heating element 215 is activated to warm the ice maker tray portion 212 until the contact surfaces of the clear ice pieces are heated and the clear ice pieces are released and slide out of the ice maker tray portion 212 and into the ice bucket 251 by the force of gravity. Alternatively, the conventional ejector fingers (not shown) can be arranged on a rotatable shaft (not shown) such that they are movable in the ice cavities 213 between vertical plates or projections 212B of the ice maker tray portion 212.

With reference to FIGS. 2A and 2B, the air handler assembly 220 is disposed at a rear portion of the ice compartment region 200. The air handler assembly 220 includes an air passage 221 having an electric motor driven fan (not visible) disposed therein. The air passage 221 communicates with an airflow duct or passage P (see FIG.

3C) under the ice maker tray portion 212. An inlet of the electric motor driven fan communicates with the airflow passage P under the ice maker tray portion 212 and through a plurality of evaporator fins 216A (see FIG. 3C) such that the electric motor driven fan creates a suction and draws cool air from the ice maker tray portion 212 and discharges the cool air through the air passage 221 and either over or around the ice bucket 251 to prevent the clear ice pieces from melting. The cool or cold air that circulates inside the insulated housing 231 of the ice compartment region 200 is only required to keep the ice compartment region 200 cold enough to prevent clear ice stored in the ice bucket 251 from melting which is normally below −3° C. and preferably, but not necessarily, around −5° C. An auger motor (not visible) is located within a lower portion of the rear housing portion 240. The auger motor includes a motor shaft 224 that protrudes from the rear housing portion 240 and that has a drive fork 225 that is connected via an auger coupler 268 to an auger 266 (see FIGS. 2A and 2B). The auger 266 guides the clear ice pieces to the opening 252 in the front cover C which are discussed later.

The air handler assembly 220 sits on the rear portion of the clear ice maker assembly 210 (see FIG. 2B). The rear housing portion 240 may be formed as a module that attaches to the rear wall 103" of the refrigerator 100 or may be assembled first inside the ice compartment housing 230. A front portion 246 of the rear housing portion 240 is configured to fit into a rear opening 235 of the ice compartment housing assembly 230 (see FIG. 2B) and thereby forms the rear wall 236 of the ice compartment housing assembly 230. A water fill tube 248 for supplying water to the clear ice maker assembly 210 extends out from the rear housing portion 240. The water fill tube 248 is connected to the water inlet pipe (not shown) in the insulated rear wall of the refrigerator 100.

With reference to FIGS. 2A and 2B, the ice compartment region 200 is formed by the ice compartment housing assembly 230 which comprises an insulated housing 231 that is configured to be mounted to the inner top wall 103', the inner back wall 103", and one of the inner side walls 103'" of the fresh food compartment 103 (see FIG. 1). In this instance, the ice compartment housing assembly 230 is disposed in an upper left hand corner of the fresh food compartment 103. The insulated housing 231 includes an outer wall 232, insulation (I) (formed of, for example, expanded polypropylene (EPP), expanded polystyrene (EPS), vacuum insolated panel (VIP)), and an inner wall 234. The ice compartment housing assembly 230 can be, for example, positioned in the upper left hand corner of the fresh food compartment 103. For example, the rear housing portion 240 may first be attached to the rear wall 103" of the refrigerator 100, and then the insulated housing 231 of the ice compartment housing assembly 230 can be fitted over the rear housing portion 240 and held in place by suitable fasteners (not shown). The mounting bracket MB of the clear ice maker assembly 210 can then be slidably engaged with the mounting grooves M on the inner walls of the ice compartment housing assembly 230 (see FIG. 2D).

With reference to FIGS. 2A and 2B, the ice bucket assembly 250 includes the ice bucket or ice bin 251 for storing the clear ice pieces and in which the auger 266 is disposed, and the insulated front cover C. The insulated front cover C can be filled with the same insulation (I) that is used in the insulated housing 231. The ice bucket 251 is shown as a removable ice bucket for storing the clear ice pieces, the ice bucket being removably disposed through a front opening 237 in the insulated housing 231 of the ice compartment region 200. The insulated front cover C can also include an ice cube/crush gate member and a cube/crush DC motor and reed switch assembly (not shown) that is used to control whether cubed or crushed ice is delivered to the user through the opening 252. A level detection device such as a bail arm (not shown) is configured to turn the automatic clear ice maker assembly 210 on when the level of the clear ice pieces has gone below a preset level as the user dispenses or removes the clear ice pieces from the ice bucket 251 for use, as well as turn off the automatic clear ice maker assembly 210 when the clear ice pieces have reached a preset full level in the ice bucket 251. Also, other level sensing devices could be used such as optical sensors.

As noted above, the ice bucket 251 is removably mounted in the ice compartment region 200. As also noted above, the insulated front cover C has an ice bucket outlet opening 252 (see FIG. 2A) on the bottom through which clear ice pieces are delivered when a user dispenses the clear ice pieces. The ice bucket outlet opening 252 cooperates with the ice chute extension 108 (see FIG. 1) to deliver clear ice pieces to the dispenser when the door 104 is in a closed position. The interface between the ice bucket outlet opening 252 and the top of the ice chute extension 108 can be sealed with a gasket, have a partial or open gasket, or have no gasket at all. In the latter two cases, some air is permitted to move between the fresh food compartment 103 and the insulated housing 231 of the ice compartment region 200 by moving into the region inside the ice chute extension 108 and through the ice bucket outlet opening 252 and into the insulated housing 231 of the ice compartment region 200 and vice versa.

With reference to FIGS. 2A-3F, 5, and 7, a detailed description will now be made of the automatic clear ice maker assembly 210 for producing clear ice according to one exemplary embodiment consistent with the present disclosure.

More specifically, as shown in FIGS. 2A, 2B, 3A, 3D, and 5, the clear ice maker assembly 210 for producing clear ice includes the ice maker tray portion 212 which is, for example, metallic and, as noted above, has the plurality of distinct ice cavities 213 preferably having equal ice geometries G formed by the equally spaced vertical plates or protrusions 212B on the evaporator plate 212A. Alternatively, the ice cavities 213' of the ice maker tray portion 212' can have several different ice geometries G' formed by unequally spaced vertical plates or protrusions 212B' on the evaporator plate 212A' as shown in FIGS. 3G and 3H (note that a prime sign (') is used to denote only the elements that are modified from those of the embodiment of FIGS. 2A, 2B, 3A, 3D, and 5). The ice cavities 213, 213' and evaporator plate 212A, 212A' of the ice maker tray portion 212, 212' are positioned on top of an evaporator cooling tube 214. As best shown in FIG. 4A, the evaporator plate 212A, 212A' is inclined at an angle downward toward the ice bucket 251. The evaporator cooling tube 214 is connected to the refrigeration circuit of the appliance, thus providing cooling capacity. The evaporator cooling tube 214 can be formed of at least one of copper or a copper alloy, for example, and is clamped between the ice maker tray portion 212, 212' and a metallic fin part 216 (see FIG. 5). The metallic fin part 216 can include a recess 214C on the top surface to receive the evaporator cooling tube 214. The metallic fin part 216 can be attached to the bottom of the evaporator plate 212A, 212A' of the ice maker tray portion 212, 212' using a plurality of fasteners such as screws S1 (see FIG. 5). Alternatively, the evaporator cooling tube 214 is die cast over-molded inside the ice maker tray portion 212 (formed of at least one of aluminum, an aluminum alloy, or other die cast alloys, for example), such that the evaporator cooling tube 214 is embedded in and thus in direct contact with the ice maker tray portion 212, 212', so as to form the ice maker tray/evaporator as a one piece unit. The evaporator cooling tube 214 has an evaporator tube inlet 214A with a capillary connection (i.e., the end is swaged and connected to a capillary tube), and an evaporator cooling tube outlet (suction tube) 214B.

As shown in FIG. 5, the defrost-heating element 215 is also clamped between the ice maker tray portion 212, 212' and the metallic fin part 216 having the plurality of evaporator fins 216A (see also FIG. 4A). The metallic fin part 216, which is also cooled directly by the evaporator cooling tube 214, is housed in a drain assembly 217 formed by a drain part 218 (formed of, for example, expanded polystyrene (EPS)) and a plastic drain cover 219, functioning an evaporator to cool the compartment air. The drain assembly 217 is attached to the ice maker tray portion 212, 212' by a plurality of fasteners such as screws S2 on one side and a tab T1 having an opening to be fitted or snapped in place over a projection P1 on the other side (see FIGS. 3D and 3E). Air, circulated by the fan motor housed in the air handler 220, is drawn into the air duct or passage P formed by the drain assembly 217 through an inlet opening 10 on a side of the clear ice maker assembly 210 nearest the front of the refrigerator 100. The air is cooled by metallic fin part 216, and directed by the air handler 220 to the insulated housing 231, thus facilitating storage of produced clear ice pieces in the ice bucket 251. As frost will tend to accumulate on the evaporator fins 216A of the metallic fin part 216, the air duct or passage P also forms a drain area D to appropriately direct melt water resulting from ice maker defrost modes and ice harvest modes. The clear ice maker defrost modes and harvest modes are facilitated by switching on the aforementioned defrost-heating element 215.

With reference to FIG. 5, a pump housing 300 is disposed at the front of the clear ice maker assembly 210 and houses a pump 302 (for example, a self-priming gear pump or a submersible pump). The pump housing 300 is attached to the front of the ice maker tray portion 212 using a plurality of fasteners such as screws S3. The pump 302 is attached to the pump housing 300 using a plurality of fasteners such as screws S4 (see FIGS. 3A, 3D, 3G, 3H, and 5). The pump housing 300 has a bulging portion 303 at the front and right side (see FIGS. 3A and 3G) to allow clearance for the pump 302 and is enclosed by a pump cover 304 which is attached to the pump housing 300 by a plurality of fasteners such as screws S5. The pump cover 304 includes a vertical plate 304A, a horizontal plate 304B, and a plurality of triangular-shaped stiffening ribs 305 therebetween to provide rigidity to the pump cover 304. The pump 302 communicates with a water reservoir tank 306 through a suction tube 308. The water reservoir tank 306 is preferably detachable from the clear ice maker assembly 210, so that the water reservoir tank 306 can be removed by the consumer for periodic cleaning or manual filling. In particular, as shown in FIG. 5, the top edge of the water reservoir tank 306 includes two tabs T2 and T3 having openings that are configured to be fitted or snapped in place over corresponding projections P2 and P3 (see also FIGS. 3E and 3G) formed, for example, on the sides of the pump cover 304. The pump 302 is configured to draw water through the suction tube 308 from the detachable water reservoir tank 306. The water is then pumped by the pump 302 through a water transfer tube 310 to a water outlet tube 312. The water outlet tube 312 will be described in detail below in connection with a water distribution assembly 400.

Figure 4D:
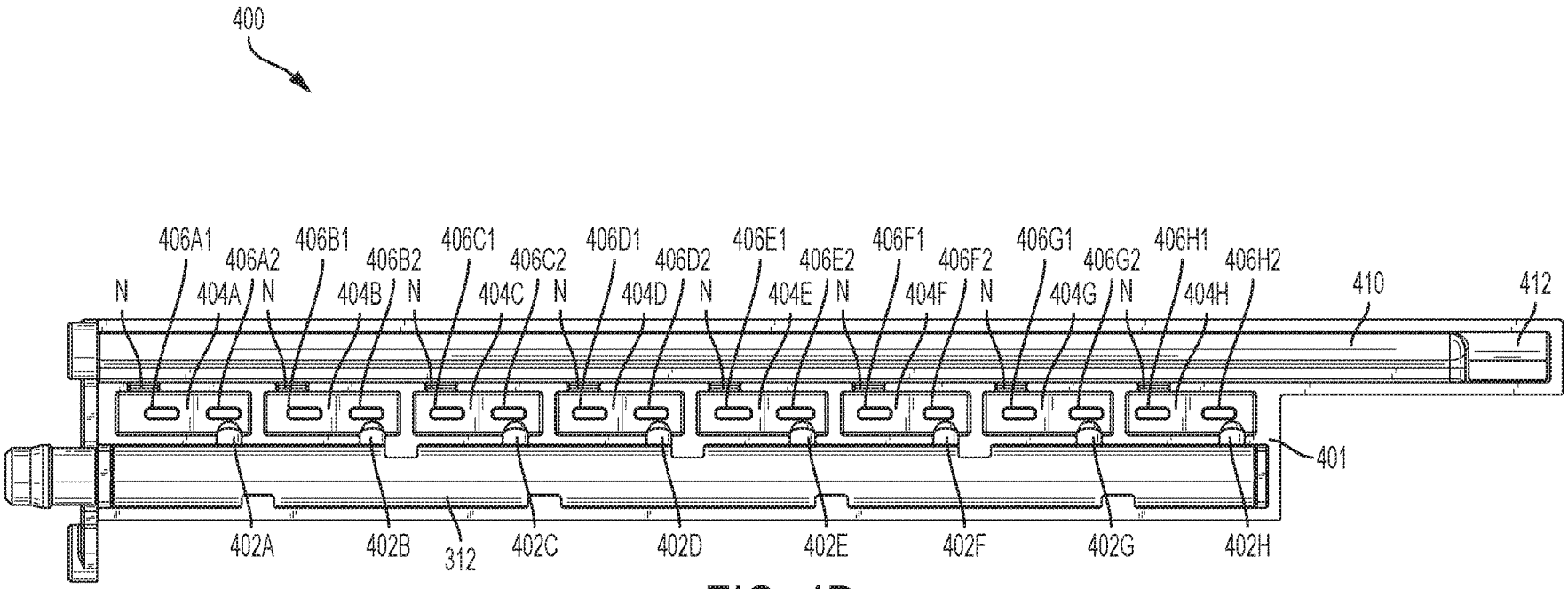

Reference will now be made to FIGS. 4A to 4D and FIG. 5 for an explanation of the water distribution assembly 400 configured to distribute a non-pressurized, even flow of water to each of the cavities 213, 213' of the ice maker tray portion 212, 212'. FIGS. 4A, 4B, 4C, and 4D are a sectional view, an enlarged sectional view of FIG. 4A, a perspective view, and a top view, respectively, to explain various portions of the water distribution assembly 400 of the clear ice maker assembly 210 according to one exemplary embodiment consistent with the present disclosure. In particular, the water outlet tube 312 is disposed in a water distribution part 401 and forms a water distribution bar. The water outlet tube 312 has, in the case of the preferred embodiment, at least one water outlet generally designated as outlet 402 for each cavity 213, 213' of the ice maker tray portion 212, 212'. In this case, eight outlets 402A through 402H are shown in FIG. 4D. Of course, significant variation of the configuration of the water outlet tube 312 is possible within the scope of the present disclosure. The water outlet tube 312 is affixed into the water distribution part 401, which is positioned above the ice maker tray portion 212, 212'. The water distribution part 401 has at least one chamber generally designated as water chamber 404 above each cavity 213, 213' of the ice maker tray portion 212, 212'. In this case, eight water chambers 404A through 404H are shown in FIG. 4D. The water W1 is discharged from the outlets 402 of the water outlet tube 312 into the water chambers 404, with each water chamber 404A to 404H having at least one outlet generally designated as outlet 406. In this case, each of the eight water chambers 404A to 404H has two outlets 406A1, 406A2; 406B1, 406B2; 406C1, 406C2; 406D1, 406D2; 406E1, 406E2; 406F1, 406F2; 406G1, 406G2; and 406H1, 406H2 which communicate with the ice cavities 213, 213', i.e., two outlets 406 communicate with each of the eight ice cavities 213, 213' (see FIG. 4D). Thus, as shown in FIG. 4B, the water W2 flows down through the outlets 406 and into a corresponding ice cavity 213, 213'. As also shown in FIG. 4B, a constant level of water is maintained in each of the water chambers 404, as excess water W3 is allowed to flow over a notch N in dividing wall 408 formed between the chambers 404 and a return duct 410. The wall opposite to the dividing wall 408 also has notches or openings 409 to allow room for the outlets 402 of the water outlet tube 312 (see FIGS. 4B and 4C). The return duct 410 is disposed adjacent to the plurality of water chambers 404. The excess water W3 flows over the notch N in the dividing wall 408 and into the return duct 410, where the excess water W3 is then directed through an outlet 412 in a bottom wall of the return duct 410 at a rear end of the return duct 410. The excess water W3 then flows into a fill cup 500 and a water collection and return duct 502 and further flows down through an outlet 503 and back to the water reservoir tank 306. The fill cup 500 includes a cutout 501 for receiving and supporting a portion of the water fill tube 248 therein.

The consistent level of water and the lack of pressurization together provide an even flow of water to each cavity 213, 213' of the ice maker tray portion 212, 212'. After the water W2 from the chambers 404 has flowed down through the outlets 406 and over the corresponding cavities 213, 213' including the inclined evaporator plate 212A, 212A' of the ice maker tray portion 212, 212', the water flows over the edge of the ice maker tray portion 212, 212' from the individual cavities 213, 213' in a waterfall like fashion and is collected into the water collection and return duct 502 that is disposed below and extends along the edge of the ice maker tray portion 212, 212' (see FIGS. 4A and 5) and that returns the excess water W2 to the water reservoir tank 306. The water collection and return duct 502 also collects water from the fill tube 248, as well as the excess water W3 from the return duct 410 of the water distribution part 401, thereby returning the water W2 and water W3 along with any water added from the fill tube 248 to the water reservoir tank 306.

As shown in FIG. 5, the rear of the clear ice maker assembly 210 maintains a hermetic seal over the drain area D to seal the air duct or passage P formed by the drain assembly 217 by using a housing part 600 formed of EPS. The housing part 600 rests on top of the rear of the ice maker tray portion 212. A support bracket 602 is attached to the rear of the ice maker tray portion 212 using a plurality of fasteners such as screws S6.

In the embodiments of FIGS. 1-5, since the cool or cold air that circulates inside the insulated housing 231 of the ice compartment region 200 is only required to keep the ice compartment region 200 cold enough to prevent clear ice stored in the ice bucket 251 from melting (for example, below −3° C. and preferably around −5° C.), the water reservoir tank 306 and the various water passages and channels (e.g., 308, 310, 312, 400, 500, 502) of the clear ice maker assembly 210 can be kept from freezing by insulating the water reservoir tank 306 and water passages and channels and by placing heaters (not shown) at the water reservoir tank 306 and water passages and channels as necessary.

When in use, ice accumulates on the ice maker tray portion 212, 212' while impurities are washed away, resulting in the formation of clear ice pieces IP, as shown in FIG. 7. Once a desired thickness of ice has accumulated, as determined by time and temperature data from the ice maker tray portion 212, 212' and water in the water reservoir tank 306, the clear ice is harvested by stopping the flow of refrigerant to the evaporator cooling tube 214 and immediately thereafter activating the defrost-heating element 215 to warm the ice maker tray portion 212, 212' until the contact surfaces of the clear ice pieces are heated and the clear ice pieces are released and slide down the inclined evaporator plate 212A, 212A' and out of the ice maker tray portion 212, 212' and into the ice bucket 251 by the force of gravity. It is also possible to pause after stopping the water flow before also stopping the flow of refrigerant to the evaporator cooling tube 214 and activating the defrost heating element 215. This allows the top layer of the clear ice piece to solidify. The water reservoir tank 306 is replenished either automatically by the refrigerator 100 or manually by the user, and the cycle can be repeated as necessary to produce an adequate storage of clear ice pieces IP. The inventors have been able to achieve clear ice pieces IP having a thickness of approximately 20 mm as shown in FIG. 7. Also, a suitable thermistor (not shown) can be disposed, for example, at the front of the ice maker tray portion 212, 212' and behind the pump housing 300.

Over time, as the concentration of impurities in the water that is stored in the water reservoir tank 306 will increase with every cycle, the stored water must be periodically evacuated and replaced. This can be done by the consumer by manual removal and cleaning of the water reservoir tank 306. In an alternate embodiment, the clear ice maker assembly 210 can purge the water by use of a switching valve (not shown), used to direct pumped water to a drain (not shown) connected to the refrigerator appliance 100 instead of circulation through the clear ice maker assembly 210. The produced clear ice pieces IP can take any shape, as dictated by the geometry G, G' of the cavities 213, 213' of the ice maker tray portion 212, 212', and thus the ice maker tray portion 212, 212' and produced ice pieces IP can appear in a wide variety of forms.

Moreover, the clear ice maker assembly 210 for producing clear ice can be equipped in a refrigerator appliance at the time of manufacture.

FIG. 6 is a fragmentary perspective view showing the inside of a refrigerator appliance including an automatic clear ice maker and an ice bucket in an ice compartment region located in a freezer compartment according to another exemplary embodiment consistent with the present disclosure. FIG. 6 shows a refrigerator appliance 10 and, in particular, the inside of a freezer compartment 11 having inlets 12 for introducing cold air, with the return air opening not being visible in the figure. At least one door 13 is mounted such as by hinges for providing access to and for closing the freezer compartment 11. In the upper left corner, for example, an ice compartment region 14 is provided and is at least partially defined by an L-shaped floor portion 15. Although the L-shaped floor portion 15 is shown with a short vertical side wall 16, the vertical side wall 16 can extend, for example, halfway or all the way to the ceiling 17 of the freezer compartment 11. An automatic clear ice maker assembly 18 is disposed in the uppermost left corner of the freezer compartment 11 in the ice compartment region 14. The automatic clear ice maker assembly 18 is configured to make clear ice pieces.

An ice bucket 21 is provided underneath the automatic clear ice maker assembly 18. Although the term ice bucket is used, ice bin, ice storage container, and the like are alternative terms for describing the ice bucket 21. The ice bucket 21 is shown as a removable ice bucket for storing ice, the removable ice bucket being removably disposed in the ice compartment region 14. The ice bucket 21 has a front portion 22 with a grip 23 for a user to grasp with their fingers to pull and slide the ice bucket 21 out of the ice compartment region 14 to access the clear ice pieces or empty the clear ice pieces from the ice bucket 21. The ice bucket 21 rests on the L-shaped floor portion 15 when it is inserted into the ice compartment region 14. The ice bucket 21 may have a raised side wall portion 24 and raised rear wall portion 25 to help retain the clear ice pieces as they slide and fall into the ice bucket 21 from the automatic clear ice maker assembly 18 during harvest and during storage as the level of the clear ice pieces increases in the ice bucket 21. A level detection device such as a bail arm (not shown) is configured to turn the automatic clear ice maker assembly 18 on when the level of the clear ice pieces has gone below a preset level as the user removes the clear ice pieces from the ice bucket 21 for use, as well as turn off the automatic clear ice maker assembly 18 when the clear ice pieces have reached a preset full level in the ice bucket 21. Also, other level sensing devices could be used such as optical sensors. As with the embodiments of FIGS. 1-5, the defrost-heating element (not visible) is activated to warm the ice maker tray portion 26 until the contact surfaces of the ice pieces are released and slide out of the ice maker tray portion 26 and into the ice bucket 21 by force of gravity. Alternatively, and although not shown, the conventional ejector fingers (not shown) can be arranged on a rotatable shaft (not shown) such that they are movable in the ice cavities 28 between vertical plates or projections of the ice maker tray portion 26.

The clear ice maker assembly 18 can be configured as one that utilizes direct cooling as in the embodiments of FIGS. 1-5 where an evaporator cooling tube either contacts or is embedded in an ice maker tray portion 26.

In the embodiment of FIG. 6, the water reservoir tank 36 and water passages and channels 38 of the clear ice maker assembly 18 can be kept from freezing by insulating the water reservoir tank 36 and water passages and channels 38 and by placing heaters (not shown) at the water reservoir tank 36 and water passages and channels 38 as necessary.

The present invention has substantial opportunity for variation without departing from the spirit or scope of the present invention. For example, while FIG. 1 shows a French door-bottom mount (FDBM) style refrigerator, the present invention can be utilized in FDBM configurations having one or more intermediate compartments (such as, but not limited to, pullout drawers) that can be operated as either fresh food compartments or freezer compartments and which are located between the main fresh food compartment and the main freezer compartment, a side-by-side refrigerator where the refrigerator compartment and the freezer compartment are disposed side-by-side in a vertical orientation, as well as in other well-known refrigerator configurations, such as but not limited to, top freezer configurations, bottom freezer configurations, and the like.

Those skilled in the art will recognize improvements and modifications to the exemplary embodiments of the present invention. All such improvements and modifications are considered within the scope of the concepts disclosed herein and the claims that follow.

What is claimed is:

1. A refrigerator comprising:

an ice compartment region disposed in at least one of a fresh food compartment or a freezer compartment;

a clear ice maker assembly disposed in the ice compartment region and which makes clear ice pieces; and an ice bucket which stores the clear ice pieces made by the clear ice maker assembly, wherein the clear ice maker assembly comprises:

an ice maker tray portion comprising an evaporator plate having a plurality of spaced apart projections which define a plurality of cavities for forming the clear ice pieces, the evaporator plate being inclined at an angle downward toward the ice bucket and each of the cavities being open at a side facing the ice bucket;

a water distribution assembly which distributes a non-pressurized flow of water to each of the cavities of the ice maker tray portion, such that the non-pressurized flow of water flows down the evaporator plate within each of the cavities;

a water reservoir tank and a pump for supplying water from the water reservoir tank to the water distribution assembly; and a water collection and return duct that is disposed below and extends along an edge of the ice maker tray portion and collects excess water exiting each of the cavities at the side facing the ice bucket and returns the excess water to the water reservoir tank, and wherein the ice accumulates in each of the cavities as the non-pressurized flow of water flows down the evaporator plate within each of the cavities to form the clear ice pieces.

2. The refrigerator of claim 1, wherein the ice compartment region is disposed in the fresh food compartment.

3. The refrigerator of claim 2, wherein the clear ice maker assembly includes an evaporator cooling tube that contacts the ice maker tray portion.

4. The refrigerator of claim 1, wherein the ice compartment region is disposed in the freezer compartment.

5. The refrigerator of claim 1, wherein the ice compartment region is disposed in an upper corner of the fresh food compartment.

6. The refrigerator of claim 1, wherein the ice bucket is removably mounted in the ice compartment region as a removable ice bucket.

7. The refrigerator of claim 6, wherein the removable ice bucket has a front cover, and the front cover has an opening in a bottom portion for discharging the clear ice pieces.

8. The refrigerator of claim 7, wherein the fresh food compartment includes a door, and further comprising an ice chute for an ice dispenser and being disposed in the door, the ice chute communicating with the opening in the front cover via an ice chute extension and to guide the clear ice pieces from the opening in the front cover to the ice dispenser.

9. The refrigerator of claim 1, wherein the refrigerator is a French door-bottom mount configuration having the fresh food compartment on top and the freezer compartment below the fresh food compartment.

10. The refrigerator of claim 1, wherein the water distribution assembly comprises a water distribution part having a water outlet tube that is connected to an outlet of the pump and has a plurality of water outlets so as to form a water distribution bar, and a plurality of water chambers, and wherein the plurality of water outlets is provided to respectively supply water to the plurality of water chambers which in turn respectively supply water to the plurality of cavities.

11. The refrigerator of claim 10, wherein the water distribution part comprises a return duct disposed adjacent to the plurality of water chambers and separated by a dividing wall, the dividing wall having notches respectively communicating with each of the plurality of water chambers, such that excess water in each water chamber flows over the notches in the dividing wall and into the return duct.

12. The refrigerator of claim 11, wherein the water collection and return duct communicates via a fill cup with the return duct of the water distribution part, thereby to return excess water from the water distribution part to the water reservoir tank.

13. The refrigerator of claim 12, wherein the return duct of the water distribution part has an outlet in a bottom wall at a rear end of the return duct of the water distribution assembly.

14. A clear ice maker assembly for use in a home refrigerator appliance, the clear ice maker assembly comprising:

an ice maker tray portion comprising an evaporator plate having a plurality of spaced apart projections which define a plurality of cavities for forming clear ice pieces, the evaporator plate being inclined at an angle downward with respect to a horizontal plane and each of the cavities being open at a lower side of the evaporator plate;

a water distribution assembly which distributes a non-pressurized flow of water to each of the cavities of the ice maker tray portion, such that the non-pressurized flow of water flows down the evaporator plate within each of the cavities;

a water reservoir tank and a pump for supplying water from the water reservoir tank to the water distribution assembly; and a water collection and return duct that is disposed below and extends along an edge of the ice maker tray portion and collects excess water exiting each of the cavities at the lower side of the evaporator plate and returns the excess water to the water reservoir tank, wherein ice accumulates in each of the cavities as the non-pressurized flow of water flows down the evaporator plate within each of the cavities to form the clear ice pieces.

15. The clear ice maker assembly of claim 14, wherein the water distribution assembly comprises a water distribution part having a water outlet tube that is connected to an outlet of the pump and has a plurality of water outlets so as to form a water distribution bar, and a plurality of water chambers, and wherein the plurality of water outlets is provided to respectively supply water to the plurality of water chambers which in turn respectively supply water to the plurality of cavities.

16. The clear ice maker assembly of claim 15, wherein the water distribution part comprises a return duct disposed adjacent to the plurality of water chambers and separated by a dividing wall, the dividing wall having notches respectively communicating with each of the plurality of water chambers, such that excess water in each water chamber flows over the notches in the dividing wall and into the return duct.

17. The clear ice maker assembly of claim 16, wherein the water collection and return duct communicates via a fill cup with the return duct of the water distribution part, thereby to return excess water from the water distribution assembly to the water reservoir tank.

18. The clear ice maker assembly of claim 17, wherein the return duct of the water distribution part has an outlet in a bottom wall at a rear end of the return duct of the water distribution part.

19. The clear ice maker assembly of claim 14, wherein the water reservoir tank is detachable from the clear ice maker assembly, so that the water reservoir tank can be removed manually for periodic cleaning or manual filling.

20. A refrigerator comprising:

a French door-bottom mount configuration having a fresh food compartment on top and a freezer compartment below the fresh food compartment;

an insulated ice compartment region disposed in the fresh food compartment;

a clear ice maker assembly disposed in the insulated ice compartment region and which makes clear ice pieces; and an ice bucket which stores the clear ice pieces made by the clear ice maker assembly, wherein the clear ice maker assembly comprises:

an ice maker tray portion comprising an evaporator plate having a plurality of spaced apart projections which define a plurality of cavities for forming the clear ice pieces, the evaporator plate being inclined at an angle downward toward the ice bucket and each of the cavities being open at a side facing the ice bucket;

a water distribution assembly which distributes a non-pressurized flow of water to each of the cavities of the ice maker tray portion, such that the non-pressurized flow of water flows down the evaporator plate within each of the cavities;

a water reservoir tank and a pump for supplying water from the water reservoir tank to the water distribution assembly; and a water collection and return duct that is disposed below and extends along an edge of the ice maker tray portion and collects excess water exiting each of the cavities at the side facing the ice bucket and returns the excess water to the water reservoir tank, and wherein ice accumulates in each of the cavities as the non-pressurized flow of water flows down the evaporator plate within each of the cavities to form the clear ice pieces.

21. The refrigerator of claim 20, wherein the clear ice maker assembly includes an evaporator cooling tube that contacts the ice maker tray portion.

* * * * *